US006634164B2

(12) United States Patent
Moser et al.

(10) Patent No.: US 6,634,164 B2
(45) Date of Patent: Oct. 21, 2003

(54) APPARATUS FOR PRODUCING A STRANDED CABLE WITH ALTERNATING TWIST DIRECTION MADE OF STRAND ELEMENTS

(75) Inventors: Walter Moser, Weigelsdorf (AT); Günther Kirchknopf, Eisenstadt (AT); Josef Stiller, Vienna (AT)

(73) Assignee: KMS Kabelmaschinen und Systeme GmbH, Hornstein (AT)

( * ) Notice: Subject to any disclaimer, the term of this patent is extended or adjusted under 35 U.S.C. 154(b) by 125 days.

(21) Appl. No.: 10/003,685

(22) Filed: Nov. 2, 2001

(65) Prior Publication Data

US 2002/0179221 A1 Dec. 5, 2002

Related U.S. Application Data

(60) Provisional application No. 60/245,528, filed on Nov. 3, 2000.

(51) Int. Cl.[7] ..... H01B 13/02

(52) U.S. Cl. ..... 57/293; 57/93; 57/204; 57/314

(58) Field of Search ..... 57/58.3, 58.36, 57/92, 93, 94, 102, 103, 104, 105, 204, 205, 236, 237, 293, 294, 314

(56) References Cited

U.S. PATENT DOCUMENTS 5,799,477 A * 9/1998 Seibert

FOREIGN PATENT DOCUMENTS

| | | | |
|---|---|---|---|
| DE | 198 16 189 A1 | * | 10/1999 |
| EP | 0 306 087 | * | 3/1989 |
| EP | 0 932 165 A1 | | 7/1999 |
| EP | 0 767 965 B1 | | 9/1999 |

* cited by examiner

*Primary Examiner*—John J. Calvert
*Assistant Examiner*—Shaun R Hurley
(74) *Attorney, Agent, or Firm*—Henry M. Feiereisen

(57) ABSTRACT

An apparatus for manufacturing stranded cables from strand elements with alternating twist directions (SZ stranding). One or more storage disks can be disposed between a guide that receives the strand elements and a stranding disk. The stranding disk and the storage disks can be driven in alternating directions. At least one torsion element drives the storage disks with a respective rotation speed that decreases with increasing distance between the storage disks and the stranding disk. The torsion element can be driven at several locations with a different rotation speed.

19 Claims, 4 Drawing Sheets

APPARATUS FOR PRODUCING A STRANDED CABLE WITH ALTERNATING TWIST DIRECTION MADE OF STRAND ELEMENTS

CROSS-REFERENCES TO RELATED APPLICATIONS

This application claims the benefit of prior filed provisional application, Appl. No. 60/245,528, filed Nov. 3, 2000, pursuant to 35 U.S.C. 119(e), the subject matter of which is incorporated herein by reference.

This application claims the priority of Austrian Patent Application Serial No. A 1869/2000, filed Nov. 3, 2000, the subject matter of which is incorporated herein by reference.

BACKGROUND OF THE INVENTION

The present invention relates to an apparatus for producing a stranded cable with alternating twist directions (SZ-stranding), and more particularly to a apparatus that is capable of driving storage disks located between an entrance guide and a stranding disk at different rotation speeds.

Unlike stranding methods using a uniform twist direction, alternating or SZ-stranding, wherein the twist direction of the strand elements changes after a certain length, does not require rotating baskets for the strand elements. These rotating spools typically permit only production of a limited length for the cable, whereas SZ-stranding allows continuous production at high drawing speeds. The strand elements traverse a stranding section that is generally bound by a fixed entrance guide and a stranding disk that can be rotated in alternating directions. To prevent the strand elements from becoming entangled within the stranding section, holding elements and/or storage disks are typically disposed between the entrance guide and the stranding disk which have through holes for guiding the strand elements. The invention is directed to driving of those storage disks.

Apparatuses are known from EP 0 932 165 A1 and EP 0 767 965 B1 wherein the storage disks are driven via a connection having rotational elasticity. For this purpose, a torsion element is used that is affixed in the region of the entrance guide and is driven in alternating directions in the region of the stranding disk. In EP 0 932 165 A1, the stranding disk and the storage disks are secured directly on the torsion element against rotation, whereas the torsion element in EP 0 767 965 B1 is spaced-apart from and parallel to the rotational axis of the stranding disk and the storage disks. The stranding disk and/or the storage disks are driven by transmission elements which are affixed on the torsion element and engage with the stranding disk and/or the storage disks. In both embodiments, the storage disks are driven at different rotations speeds that decrease with increasing distance from the stranding disk. This arrangement effectively prevents the strand elements in the stranding section from becoming entangled.

The aforedescribed embodiments, however, have in common that it is difficult to adjust the rotation speed of the individual storage disks with the required accuracy. Accordingly, an attempt was made to accurately control the local rotation speed by varying the elastic modulus of the torsion elements over the running length. This approach is no longer feasible at the greater rotation speeds common with SZ-stranding due to the increasingly significant mass inertia within the torsion elements. Individual storage disks can retain their previous rotation direction during a short time when the rotation direction of the drive in the region of the stranding disk is reversed. This causes an undesirable and uncontrolled phase shift of the storage disks which places an upper limit on the achievable stranding speed.

It would therefore be desirable to provide a stranding apparatus with a torsion element that drives the storage disks and simultaneously allows a precise control of the rotation speeds of the individual storage disks.

SUMMARY OF THE INVENTION

According to one aspect of the invention, an apparatus for manufacturing a stranded cable from strand elements with alternating twist directions (SZ stranding) is provided, which includes a guide adapted to receive the strand elements and a stranding disk that can be driven in alternating directions. The apparatus further includes a plurality of storage disks disposed between the guide and the stranding disk. At least one torsion element is provided that is driven at several locations along the torsion element with different rotation speeds, with the storage disks being driven in such a way that their rotation speed decreases with increasing distance from the stranding disk.

With this arrangement, the required driving torque can be applied to the torsion elements at different locations. Only very small corrections to the torque are required when using a single torsion element which thereby operates as a transmission gear for the individual storage elements. Most importantly, these additional torque corrections substantially eliminate the disadvantages associated with a single drive for the stranding disk, thereby permitting greater stranding speeds.

According to an advantageous embodiment of the invention, stranding machines that have to produce large stranding forces for manufacturing a stranded product may include individual drive units located at at least two locations of the torsion element. Conversely, lightweight stranded products may be produced using only a single main drive having a gear with driving several driven assemblies that are non-rotatably connected with the torsion elements.

When a flexible design is desired that allows an easy exchange of the torsion element, the torsion element may be located spaced apart from and parallel to the longitudinal axis of the stranding section. The storage disks can be driven using transmission elements.

If a compact construction is desired, the torsion element can be guided centrally along the longitudinal axis of the stranding section, in which case the storage disks are non-rotatably secured directly on the torsion element and drive the torsion element directly. This obviates the need for separate drive disks in addition to the already existing storage disks.

A better control over the rotation speed of the individual storage disks can be achieved by varying the elastic modulus of the torsion element over its length.

According to another advantageous embodiment of the invention, the torsion element can be made of at least two, preferably four, mutually parallel individual rods, whereby the tendency of the torsion element to oscillate in the transverse direction is significantly reduced.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
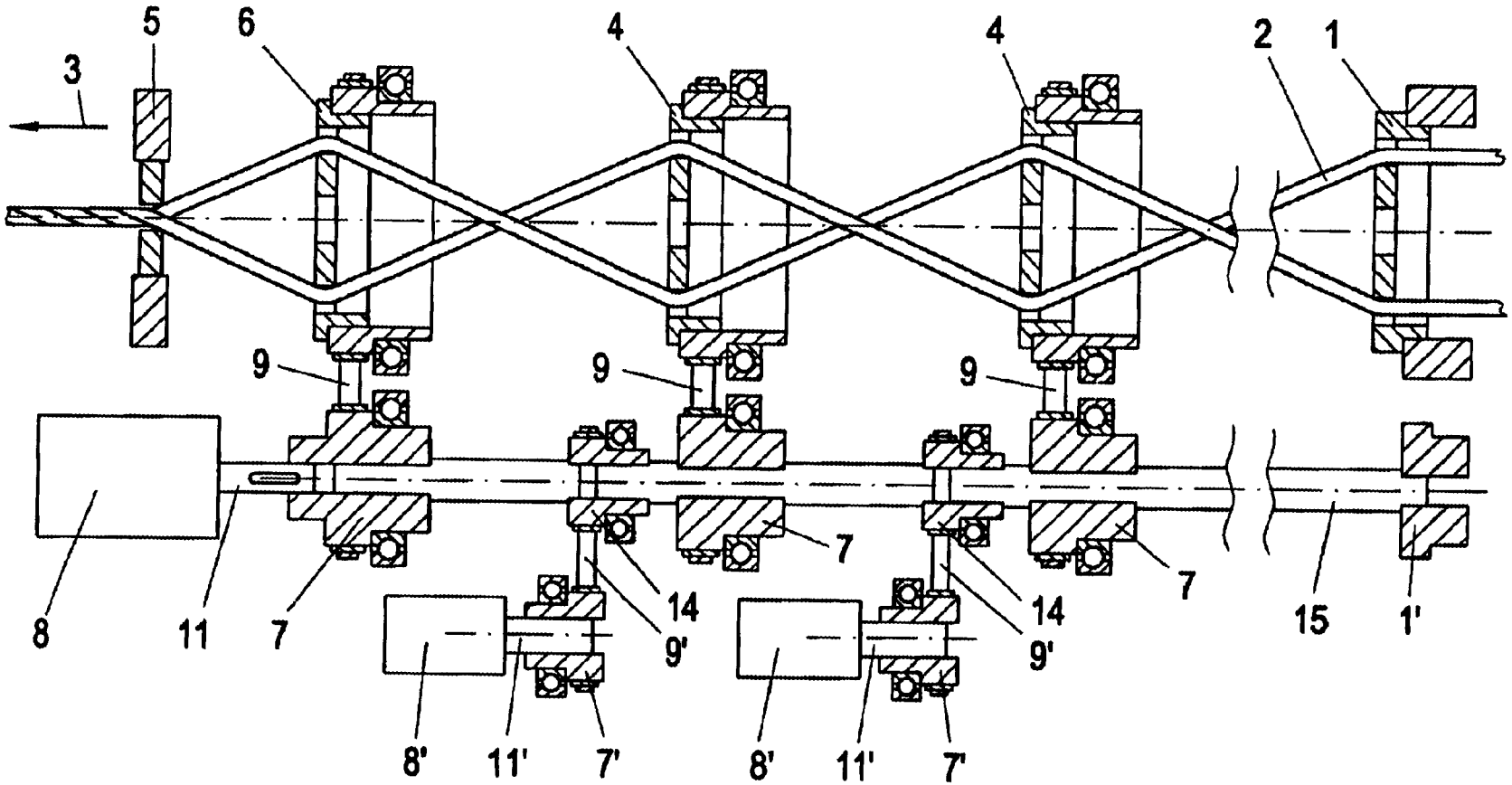
FIG. 1 is a cross-sectional view of a first embodiment of an apparatus for producing a stranded cable with alternating twist direction made of strand elements in accordance with the present invention.

Throughout all the Figures, same or corresponding elements are generally indicated by same reference numerals.

The invention is directed to a apparatus for manufacturing a stranded cable from strand elements with alternating twist directions. In particular, the apparatus described herein permits a high stranding speed by precisely controlling the rotation speeds of individual storage disks.

Turning now to the drawing, and in particular to FIG. 1, there is shown a cross-sectional view of a first embodiment of a apparatus for producing a stranded cable with alternating twist direction made of strand elements in accordance with the present invention The apparatus includes a stranding section that is bound by a stationary (entrance) guide 1 and a stranding disk 6 that can be rotated in alternating directions. Strand elements 2 traverse the stranding section, wherein the strand elements 2 can be implemented, for example, as individual wires and/or as optical waveguides and the like.

In the embodiment depicted in FIG. 1, the guide 1 is fixed and includes bores spaced at an equal distance from a longitudinal axis of the stranding section and adapted to receive the strand elements 2. In the pulling direction of the strand elements 2, which is indicated by the arrow 3, uniformly spaced storage disks 4 are arranged subsequent to the stationary guide 1. These storage disks 4 also include bores arranged at an equal distance from the rotation axis of the storage disks 4 and adapted to receive the strand elements 2. The storage disks 4 and the stranding disk 6 can be driven in alternating directions. A cable guide 5 through which the cable is withdrawn is arranged after the stranding disk 6.

In this embodiment, drive disks 7 that are coupled to a motor 8 drive the storage disks 4 and the stranding disk 5 via respective transmission elements 9. FIG. 1 shows these transmission elements 9 as being implemented as a belt. However, other types of transmission elements 9, such as toothed wheels, can also be employed.

The drive disks 7 are coupled to the motor 8 via a torsion element 15 which in the embodiment of FIG. 1 is positioned in spaced-apart relationship parallel to the longitudinal axis of the stranding section and is affixed to a frame section in the region of a stationary guide 1'. The motor 8 and its shaft 11, respectively, can be non-rotatably secured to the drive disk 7 that is non-rotatably connected with the torsion element 15 and drives the stranding disk 6. The drive disks 7 that are associated with the storage disks 4 are also non-rotatably connected with the torsion element 15. All the drive disks 7 that are coupled with the torsion element 15, as well as the associated storage disks 4 and the stranding disk 6 can have an identical gear ratio.

The torsion element can be affixed in the region of the guide 1, so that the storage disks 4 have different rotation speeds that decrease with increasing distance from the stranding disk.

Alternatively, instead of driving the storage disks 4 via a single torsion element 15, several mutually independent or operatively coupled torsion elements 15 can be employed. For example, several torsion elements 15 could be arranged sequentially along the longitudinal axis of the stranding section.

As illustrated in FIG. 1, separate drive units can be placed at several locations of the torsion element 15 to provide the required torque corrections. These drive units include drive disks 14 which are each connected via a belt 9' with respective drive disks 7' that are each coupled to a motor 8' and the respective motor shaft 11'. This embodiment is advantageous, for example, for stranding machines that require large stranding forces to manufacture a stranded product.

Alternatively, the separate torque corrections can also be provided by a gear that is coupled to a single main drive, wherein the gear has several driven shafts that are connected with the drive disks 14 of the torsion element 15.

Figure 2:
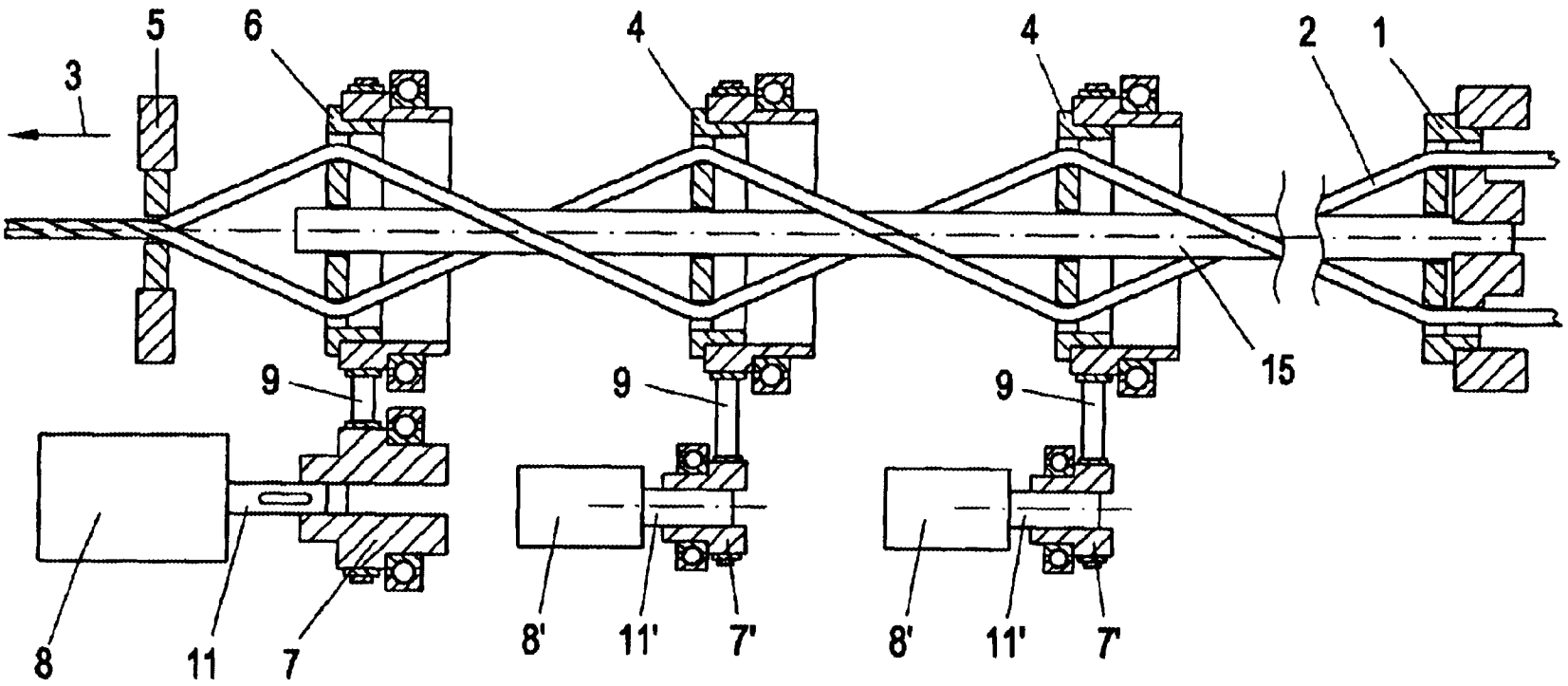
FIG. 2 is a cross-sectional view of a second embodiment of an apparatus for producing a stranded cable with alternating twist direction made of strand elements in accordance with the present invention.

In another embodiment depicted in FIG. 2, the torsion element 15 can be guided centrally along the longitudinal axis of the stranding section, with the storage disks 4 being non-rotatably secured directly the torsion element. In this embodiment, the torsion element 15 is driven directly via the storage disks 4 using belts 9. The same principle can also be employed with the embodiment described above with reference to FIG. 1. For example, the drive disks 7' can engage directly with the storage disks 4 although the torsion element 15 may be located in spaced apart relationship parallel to the longitudinal axis.

This arrangement obviates the need for providing separate drive disks 14' in addition to the already existing storage disks 4.

Figure 3:
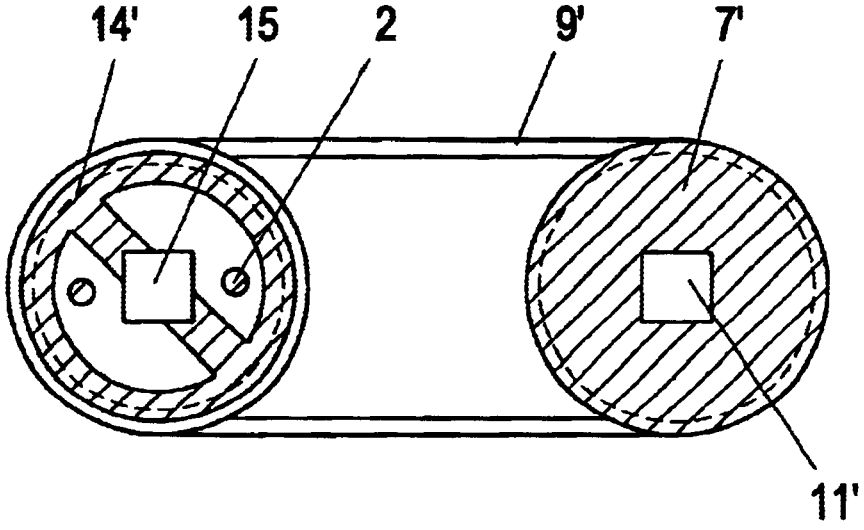
FIG. 3 is a partial sectional view of a drive disk for an exemplary torsion element.
Figure 4:
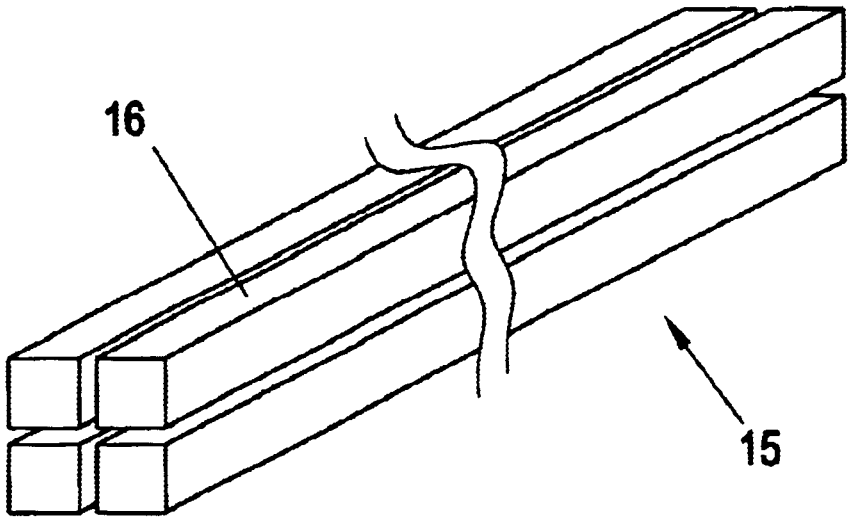
FIG. 4 is a perspective partially cut view of a torsion element formed by four individual rods.

FIG. 3 illustrates another embodiment wherein separate drive disks 14' are provided which are non-rotatably secured to the torsion element 15 and are driven by the drive disks 7' via a belt 9'. In this embodiment, the storage disks 4 do not apply the torque directly to the torsion element 15 and the strand elements 2 can be guided without obstruction.

Figure 5:
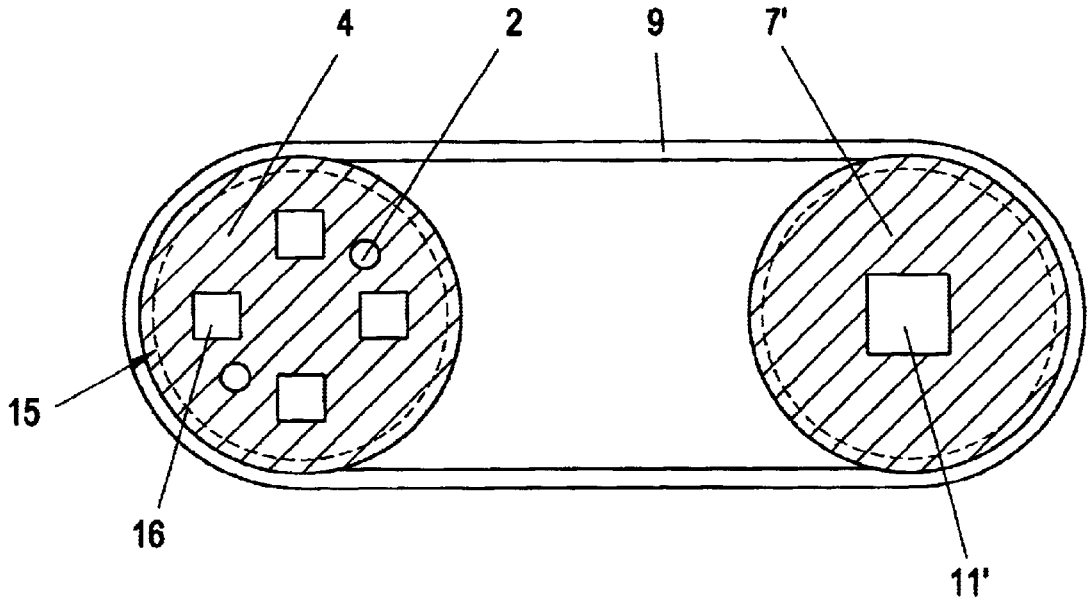
FIG. 5 is a schematic illustration of the torsion element formed by four individual rods with a n applied torque.

The torsion element 15 can be formed, for example, by tensioned, extensible elements in the form of filaments or tapes which can be guided through eccentrically positioned bores provided in the drive and/or storage disks. The torsion element 15 can also be implemented as a torsion spring or a torsion rod. According to another advantageous embodiment of the invention, the torsion rod can be formed by two, preferably four, mutually parallel individual rods 16, to significantly reduce the tendency of the torsion element 15 to oscillate in the transverse direction. The individual rods 16 can also be placed side-by-side, or as shown in FIG. 5, spaced apart.

Moreover, the torsion element 15 can have an elastic modulus that varies in the longitudinal direction to compensate the mass inertia of the individual components at high acceleration.

While the invention has been illustrated and described as embodied in an apparatus for producing a stranded cable with alternating twist direction made of strand elements, it is not intended to be limited to the details shown since various modifications and structural changes may be made without departing in any way from the spirit of the present invention.

What is claimed as new and desired to be protected by Letters Patent is set forth in the appended claims:

What is claimed is:

1. Apparatus for manufacturing a stranded cable from strand elements with alternating twist directions (SZ stranding), comprising:

a guide adapted to receive the strand elements;

a stranding disk that can be driven in alternating directions;

a plurality of storage disks disposed along a common longitudinal axis between the guide and the stranding disk; and at least one torsion element extending parallel to the common longitudinal axis and being driven at several locations with different rotation speeds, wherein the torsion element drives the plurality of storage disks with different disk rotation speeds that decrease with increasing distance between a storage disk and the stranding disk.

2. The apparatus of claim 1, comprising at least two separate drive units that drive the torsion element at separate locations of the torsion element.

3. The apparatus of claim 1, comprising a single drive unit with a gear, wherein the gear includes several driven shafts that are non-rotatably connected with the torsion element.

4. The apparatus of claim 1, wherein the torsion element is guided between the guide and the stranding disk with a spacing from the common longitudinal axis.

5. The apparatus of claim 4, further comprising transmission elements that drive the storage disks.

6. The apparatus of claim 5, wherein the transmission elements include a plurality of belts, with each belt operatively connecting the torsion element with a respective one of the storage disks.

7. The apparatus of claim 5, wherein the transmission elements include drive disks that are non-rotatably secured to the torsion element.

8. The apparatus of claim 7, wherein at least one of the drive disks has eccentrically positioned bores and the torsion element comprises a plurality of tensioned and extensible elements that are guided through the bores.

9. The apparatus of claim 8, wherein the tensioned and extensible elements are selected from the group consisting of filaments and tapes.

10. The apparatus of claim 1, wherein the torsion element is guided along the longitudinal axis between the guide and the stranding disk and the storage disks are non-rotatably secured on the torsion element.

11. The apparatus of claim 10, wherein the storage disks drive the torsion element.

12. The apparatus of claim 1, wherein the torsion element has an elastic modulus that varies along a longitudinal extent of the torsion element.

13. The apparatus of claim 1, wherein the torsion element comprises at least two mutually parallel rods.

14. The apparatus of claim 13, wherein the torsion element comprises at least four mutually parallel rods.

15. The apparatus of claim 13, wherein the parallel rods are arranged side-by-side.

16. The apparatus of claim 13, wherein the parallel rods are arranged so as to form a gap between the rods.

17. The apparatus of claim 1, wherein the torsion element comprises a torsion spring.

18. The apparatus of claim 1, wherein at least one of the storage disks has eccentrically positioned bores and the torsion element comprises a plurality of tensioned and extensible elements that are guided through the bores.

19. The apparatus of claim 18, wherein the tensioned and extensible elements are selected from the group consisting of filaments and tapes.

* * * * *